United States Patent [19]

Wong

[11] Patent Number: 4,701,727

[45] Date of Patent: Oct. 20, 1987

[54] STRIPLINE TAPPED-LINE HAIRPIN FILTER

[75] Inventor: Joseph S. Wong, Upland, Calif.

[73] Assignee: General Dynamics, Pomona Division, Pomona, Calif.

[21] Appl. No.: 675,782

[22] Filed: Nov. 28, 1984

[51] Int. Cl.[4] ..... H01P 1/203

[52] U.S. Cl. ..... 333/204; 333/219

[58] Field of Search ..... 333/202, 204, 205, 219, 333/246, 110

[56] References Cited

U.S. PATENT DOCUMENTS

| | | | |
|---|---|---|---|
| 2,411,555 | 11/1946 | Rogers | 333/202 |
| 2,945,195 | 7/1960 | Matthaei | 333/204 X |
| 2,968,012 | 1/1961 | Alstadter | 333/204 |
| 3,391,356 | 7/1968 | Bolljahn et al. | 333/204 |
| 3,451,015 | 6/1969 | Heath | 333/204 |
| 3,582,841 | 1/1971 | Rhodes | 333/203 |
| 3,605,045 | 9/1971 | Ramsbotham, Jr. | 333/204 |
| 3,621,367 | 11/1971 | Rosen | 321/69 W |
| 3,644,850 | 2/1972 | Ho | 333/204 |
| 3,668,569 | 6/1972 | Herring | 333/204 X |
| 3,754,198 | 8/1973 | Anghel | 333/204 |
| 3,805,198 | 4/1974 | Gewartowski et al. | 333/204 |

FOREIGN PATENT DOCUMENTS 1103309 7/1984 U.S.S.R. ..... 333/110

OTHER PUBLICATIONS

"Microstrip Tapped-Line Filter Design", Joseph E. Wong, Jan. 1979 from IEEE Transactions on Microwave Theory and Techniques, vol. MTT-27, No. 1.

*Primary Examiner*—Eugene R. LaRoche
*Assistant Examiner*—Benny T. Lee
*Attorney, Agent, or Firm*—Neil F. Martin; Russell Ben Miller; Edward B. Johnson

[57] ABSTRACT

A stripline tapped-line filter is disclosed including a first substrate upon which a plurality of N hairpin resonators are disposed alternately on opposite surfaces of the first substrate. Each one of the hairpin resonators is in a parallel coupled relationship with an adjacent hairpin resonator disposed on an opposite surface of the first substrate. The first and last hairpin resonators each have an interconnected member disposed on the substrate for respectively coupling a signal into and out of the plurality of N hairpin resonators. Second and third substrates are included with each being respectively located adjacent to ones of the plurality of N hairpin resonators on opposite surfaces of the first substrate. First and second groundplanes are included with each respectively located adjacent the second and third substrates.

12 Claims, 9 Drawing Figures

STRIPLINE TAPPED-LINE HAIRPIN FILTER

ACKNOWLEDGMENT

The United States Government has rights in this invention pursuant to Contract No. N00024-80-C-5117, awarded by the U.S. Navy.

BACKGROUND OF THE INVENTION

1. Technical Field

The present invention relates to stripline filters. More specifically, the present invention relates to a novel stripline tapped-line hairpin filter.

2. Background Art

Microstrip and stripline filters are employed for filtering microwave frequency signals or other types of high frequency signals. Microstrip and stripline filters are commonly used in high frequency filtering applications. One such application is in a radar system wherein received signals are filtered, i.e., signals of a particular frequency range pass through the filter, for further processing. Striplines have the inherent advantage over microstrip in that opposite surfaces of a substrate may have circuit elements disposed thereon. The stripline circuit element-substrate-circuit element structure is sandwiched between the two conductive groundplanes and insulated therefrom by two dielectric substrates. Microstrips typically have circuit elements formed on one surface of a dielectric substrate and a groundplane formed on the opposite surface.

One type of microwave frequency filter uses a microstrip parallel coupled filter. The microstrip parallel coupled filter has the disadvantage that input and output end sections are required to couple the signals into and out of the filter which is comprised of a plurality of N circuit elements. The input and output end sections are respectively parallel coupled to the first and last resonators of the N circuit element filter. Thus, additional surface area is required to form the additional input and output end sections for the N circuit element filter. A further disadvantage occurs in the situation where the parallel coupling at the end sections becomes very tight and physical realization becomes impractical.

Other types of microstrip filters include the tapped-line interdigital and combline filters. These type of microstrip filters have the advantage over the parallel coupled filters by virtue of the tapped-line feature. The tapped-line feature allows the first and last resonators to also serve as the input and output sections. This provides savings in space and an improvement in filter bandwidth. For example, a 20 to 30 percent bandwidth may be achieved using the tapped-line interdigital filter. However, physical limitations exist due to the coupling spacing requirements between adjacent microstrip filter elements, thus limiting further expansion of the filter bandwidth.

Another type of microstrip filter is the parallel coupled hairpin filter. The parallel coupled hairpin filter uses a plurality of N hairpin shaped resonators disposed on a surface of the substrate with alternating orientation. The parallel coupled hairpin filter requires input and output end sections which provide parallel coupling of the signal in and out of the filter. However, in certain situations the parallel coupling between the end sections and the first and last resonators may become very tight and physical realization may not be practical. Therefore, this type of filter is limited in bandwidth due to the tight coupling at the end sections. In addition, extra space is required for the end sections on the surface of the substrate.

Another type of microstrip filter is the tapped-line hairpin filter. The microstrip tapped-line hairpin filter eliminates the need for end sections to couple signals into and out of the parallel coupled hairpin resonators. This allows an increase of the bandwidth in the range of 30 to 40 percent. A design using the tapped-line hairpin filter is described in an article entitled "Microstrip Tapped-Line Filter Design" by Joseph S. Wong, *IEEE Transactions On Microwave Theory and Techniques,* Volume MTT-27, No. 1, January 1979.

In many applications the microstrip filter provides sufficient bandwidth. However, in some applications a greater bandwidth is required, such as in excess of 40 percent. Microstrip filters of this type will not permit bandwidths higher than 40 percent due to the physical limitations, i.e., required spacing between adjacent filter elements. Thus, the spacing requirement between adjacent microstrip filter elements limits the overall frequency bandwidth of the filter.

The microstrip approach limits the bandwidth due to the adjacent construction of the filter elements, on a single surface of the substrate. As the bandwidth increases the impedance between adjacent filter elements correspondingly increase, i.e., coupling becomes tighter. Since the tightest coupling occurs at the input and output adjacent resonators, once the coupling is too tight in these areas, the filter is no longer realizable.

It is, therefore, an object of the present invention to provide a wideband microwave filter.

It is another object of the present invention to provide a stripline bandpass filter for microwave applications having a wide bandwidth capability.

It is yet another object of the present invention to provide a stripline bandpass filter using hairpin resonators spaced alternately on opposite surfaces of a dielectric substrate wherein the first and last hairpin resonators are respectively tapped for signal input and output.

SUMMARY OF THE INVENTION

The present invention provides a stripline tapped-line hairpin filter including a first substrate; a plurality of N hairpin resonators disposed alternately on opposite surfaces of the first substrate, ones of said plurality of N hairpin resonators located on each of the opposite surfaces of the first substrate being in a spaced parallel relationship with respect to another such that each one of the plurality of N hairpin resonator is in a parallel coupled relationship with an adjacent one of said plurality of N hairpin resonators disposed on an opposite surface of the first substrate, and the first and last ones of the plurality of N hairpin resonators having an interconnected tapping member disposed on the substrate for respectively coupling a signal into and out of the plurality of N hairpin resonators; second and third substrates each respectively located adjacent to ones of said plurality of N hairpin resonators on opposite surfaces of the first substrate; and first and second groundplanes each respectively located adjacent the second and third substrates.

The present invention provides for a stripline tapped-line hairpin filter wherein the hairpin resonators are located alternately on opposite surfaces of a substrate. The first and last hairpin resonators are tapped to permit signal input and output of the filter. The hairpin resonator carrying substrate is sandwiched between two groundplanes insulated therefrom by a pair of dielectric substrates. The stripline tapped-line hairpin filter allows for a bandpass filter which has a greater band-width than previous designs. The alternately formed hairpin resonators may be spaced in overlapping fashion to obtain coupling that was physically impossible in microstrip application where the reasonators were located on a single surface. The tapped input and output hairpin resonators permit direct input and output coupling to the filter without the limitations of additional parallel coupled end sections and the physical spacing limitations associated therewith.

BRIEF DESCRIPTION OF THE DRAWINGS

These and other features, objects, and advantages of the invention will be more fully apparent from the detailed description set forth below taken in conjunction with the drawings in which like reference characters identify corresponding throughout and wherein:

FIG. 7A is a schematic representation of a single tapped hairpin resonator while

DETAILED DESCRIPTION OF THE PREFERRED EMBODIMENTS

Figure 1:
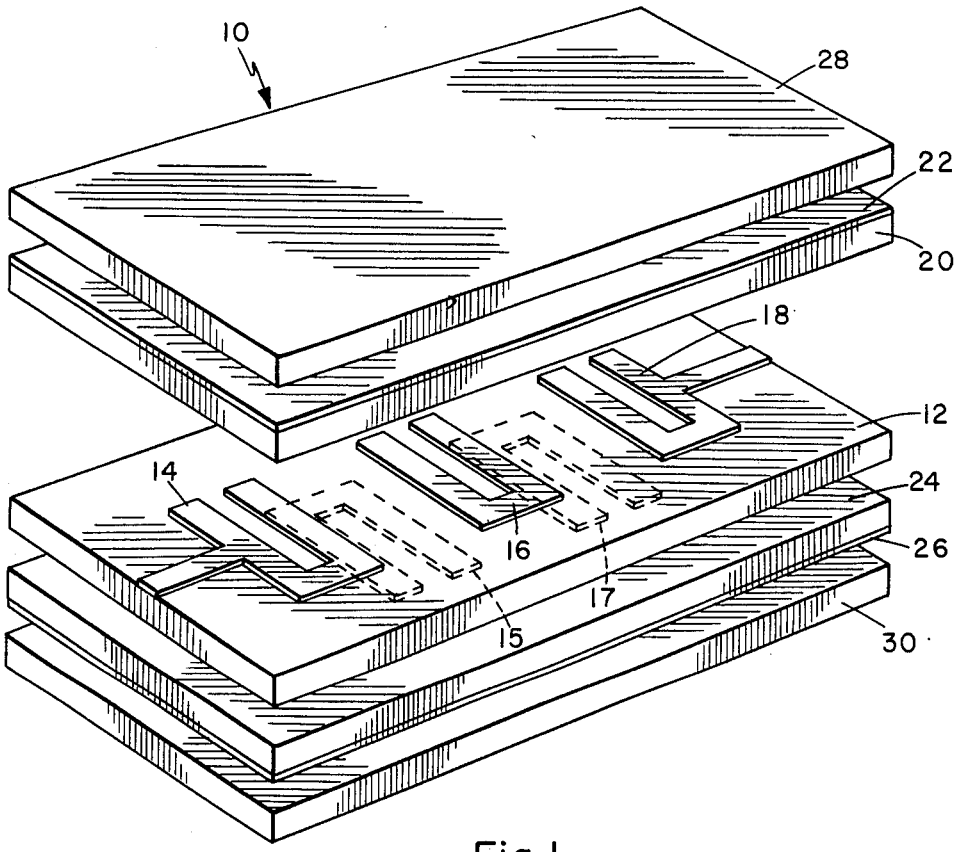
FIG. 1 is a perspective view of an exemplary embodiment of a stripline tapped-line hairpin filter constructed in accordance with the present invention, the portions of the sandwiched filter being separated for illustrative purposes.

The present invention comprises a novel stripline tapped-line hairpin filter. Referring to FIG. 1, there is shown a stripline tapped-line hairpin filter 10. Filter 10 includes a dielectric substrate 12 upon which a plurality of N hairpin resonators, 14–18, are disposed thereupon in alternating sequence on opposite surfaces of substrate 12. Each hairpin resonator is comprised of a conductive material. Although only five hairpin resonators are illustrated in FIG. 1, the disclosure of the present invention is not limited to five hairpin resonators.

Substrate 12, with hairpin resonators 14–18 disposed thereon, is sandwiched between a pair of dielectric substrates 20 and 24. It is preferred that substrates 20 and 24 be coextensive with and parallel to substrate 12. In addition, it is preferred that substrates 20 and 24 have the same dielectric constant as substrate 12.

Substrates 20 and 24 have respectively disposed upon a surface thereof, electrically conductive groundplanes 22 and 26. Groundplane 22 is disposed on a surface of substrate 20 which is opposite a surface of substrate 20 facing hairpin resonators 14, 16, and 18. Groundplane 26 is similarly disposed on a surface of substrate 24 which is opposite the surface facing hairpin resonator 15 and 17.

Respectively disposed adjacent to groundplanes 22 and 26 are electrically conductive plates 28 and 30. Conductive plates 28 and 30 are used in holding the stripline structure together. Conductive plates 28 and 30 are substantially coextensive with and parallel to groundplanes 22 and 26.

Figure 2:
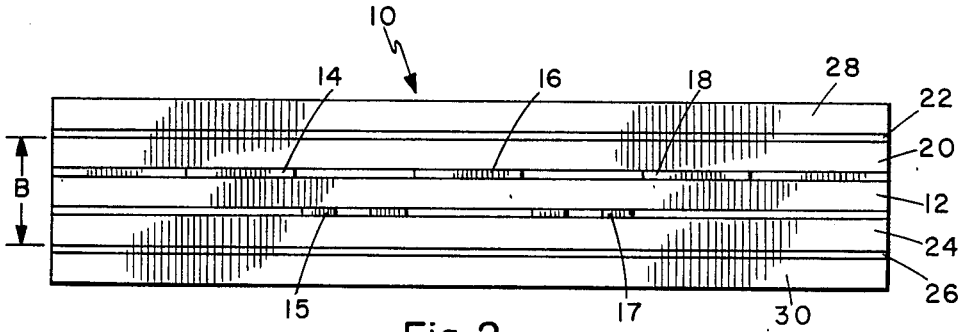
FIG. 2 is a side plan view of the stripline tapped-line hairpin filter of the present invention.

Referring to FIG. 2, there is shown the stripline tapped-line hairpin filter of FIG. 1 in a side plan view with the component parts mounted together. Hairpin resonators 14, 16, 18, are disposed on an upper surface of substrate 12 while hairpin resonators 15 and 17 are disposed on a lower surface of substrate 12. Thus, the hairpin resonators 14–18 are alternately disposed on opposite surfaces of substrate 12. The dimension B is indicated as being the thickness of filter 10 between groundplanes 22 and 26. The dimension B used in Filter 10 is the same dimensional groundplane-to-groundplane thickness used in a test structure wherein the coupling coefficient versus spacing is experimentally determined.

As illustrated in FIG. 2, the stripline components are mounted adjacent each other between conductive plates 28 and 30. The filter components may be clamped together by screws (not shown) or bonded together by means well known in the art.

Figure 3:
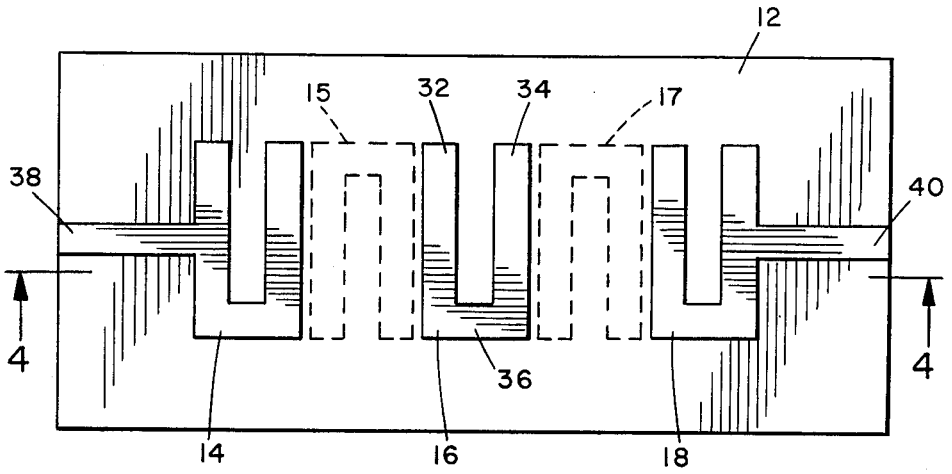
FIG. 3 is a top plan view of a stripline substrate having a plurality of hairpin resonators disposed thereupon with the first and last hairpin resonators being tapped.

FIG. 3 illustrates a top plan view of dielectric substrate 12 having disposed upon a top surface thereof, hairpin resonators 14, 16, and 18. Disposed upon a bottom surface of substrate 12 are hairpin resonators 15 and 17. Hairpin resonators 14, 16, and 18 are disposed upon the top surface of substrate 12 such that there exists an opposite orientation from hairpin resonators 15 and 17 located on the bottom surface of substrate 12. Hairpin resonators 14, 16 and 18 are arranged in a parallel spaced relationship with respect to each other. Hairpin resonators 15 and 17 are also arranged in a parallel spaced relationship with respect to each other.

Each hairpin resonator formed on substrate 12 is comprised of a pair of spaced parallel conductive members interconnected at one end by a third member perpendicular to the parallel spaced members. For example, hairpin resonator 16 is comprised of parallel spaced members 32 and 34. Parallel members 32 and 34 are interconnected at one end by perpendicular member 36. The ends of parallel members 32 and 34 are therefore shorted by perpendicular member 36. The ends of parallel members 32 and 34 opposite perpendicular member 36 are therefore open circuited.

The first and last hairpin resonators on substrate 12 are hairpin resonators 14 and 18. Hairpin resonators 14 and 18 are tapped to permit signal input and output for the filter. Hairpin resonator 14 includes a conductive tapping member 38 disposed on substrate 12 which perpendicularly intersects an outermost parallel member of the paired parallel members of hairpin resonator 14, with respect to the adjacent hairpin resonator 15. Conductive member 38 extends outwardly from the outermost one of the paired parallel members of hairpin resonator 14 along substrate 12 in a direction away from hairpin resonator 15 and toward one end of substrate 12. Hairpin resonator 18 includes a conductive tapping member 40 disposed upon substrate 12 which perpendicularly intersects with an outermost parallel member of the paired parallel members of hairpin resonator 18, with respect to the adjacent hairpin resonator 17. Conductive member 40 extends outwardly from the outermost one of the paired parallel members of hairpin resonator 18 along substrate 12 in a direction away from hairpin resonator 17 towards the other end of substrate 12.

Hairpin resonators 14, 15, 16, 17, and 18 are illustrated in FIG. 3 as having parallel members, which at the end opposite the perpendicular member have squared off corners. In addition, hairpin resonators 14, 15, 16, 17, and 18 have squared off exterior corners, at the end where the parallel and perpendicular members intersect.

Figure 4:
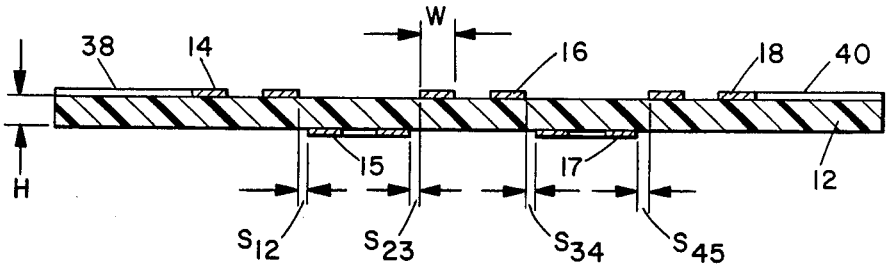
FIG. 4 is a sectional view taken across line 4—4 of the stripline tapped-line hairpin resonator carrying substrate of FIG. 3.

FIG. 4 illustrates a sectional view taken across line 4—4 of substrate 12 of FIG. 3. In the preferred embodiment of the hairpin resonators, all of the parallel, perpendicular, and tapping members are fixed at an equal stripwidth W. Thus, the stripwidth of parallel members 32 and 34, perpendicular member 36, and tapping members 38 and 40 are equal. Since adjacent hairpin resonators are formed alternately on opposite surfaces of substrate 12 they may be spaced apart or overlap in the plane parallel to the surface of substrate 12. For example, hairpin resonators 14 and 15 are separated in the plane parallel to the surface of substrate 12 i.e., lateral direction, by a gap space defined as $S_{12}$. Hairpin resonators 15 and 16 are separated in the lateral direction by space $S_{23}$. Hairpin resonators 16 and 17 are separated in the lateral direction by space $S_{34}$ while hairpin resonators 17 and 18 are separated in the lateral direction by space $S_{45}$. The thickness of substrate 12 is defined by the thickness H.

Figure 5:
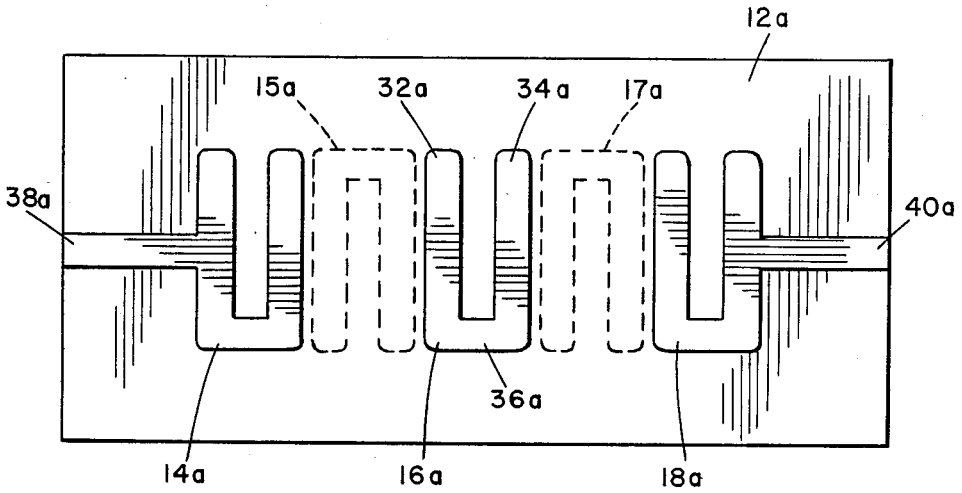
FIG. 5 is a top plan view of a stripline substrate having a plurality of hairpin resonators disposed thereupon with the first and last hairpin resonators being tapped and the corners of the hairpin resonators being rounded.

FIG. 5 illustrates an alternate embodiment of the hairpin resonators formed upon substrate 12*a*. Hairpin resonators 14*a*, 15*a*, 16*a*, 17*a*, and 18*a* are formed as previously described on alternate surfaces of substrate 12*a*. Hairpin resonators 14*a* and 18*a* have respectively formed therewith upon substrate 12*a* tapping member 38*a* and 40*a*. Each of the hairpin resonators in FIG. 5 comprise parallel spaced conductive members having a perpendicular member intersecting the parallel members at one end thereof. Hairpin resonator 16*a* is comprised of parallel members 32*a* and 34*a*. Parallel members 32*a* and 34*a* are interconnected at one end by perpendicular member 36*a*. At the end opposite of perpendicular member 36*a*, the edges of parallel members 32*a* and 34*a* are rounded in the plane parallel to substrate 12*a*. At the end of parallel members 32*a* and 34*a* where perpendicular member 36*a* intersects thereat the corners exterior to parallel members 32*a* and 34*a* are also rounded in the plane parallel to the surface of substrate 12*a*.

The present invention takes advantage of parallel coupling between adjacent hairpin resonators located on opposite surfaces of a substrate. To design a hairpin resonator filter according to the present invention, the singly loaded Q ($Q_s$) of the first and last hairpin resonators produced by tapping and the coupling coefficient (K) must be determined. The article entitled "Microstrip Tapped-Line Filter Design" previously described, discusses a technique for experimentally determining the coupling coefficients of a pair of hairpin resonators.

Using the experimental procedure to determine the coupling coefficients, a plurality of hairpin resonators are disposed alternately on opposite surfaces of a selected dielectric substrate material having a fixed reference thickness ($H_1$). The hairpin resonators are disposed such that the spacing between hairpin resonators varies in a lateral direction, with reference to the surfaces of the substrate, from overlapping to wide spacing between adjacent hairpin resonators. The dielectric material selected for the substrate has a fixed dielectric constant ($E_R$). Each hairpin resonator has an equal reference stripwidth ($W_1$) when disposed upon the surface of the substrate. The hairpin resonator carrying substrate is then disposed between a pair of substrates having a fixed thickness and being of the same dielectric material and permittivity as is the hairpin resonator carrying substrate. Groundplanes are disposed upon parallel surfaces of the substrate materials exterior to the stack of substrates, which sandwich the hairpin resonator carrying substrate. The distance between groundplanes becomes a fixed reference thickness ($B_1$).

Upon constructing the test structure as just described, the coupling coefficient (K) of each spaced pair of adjacent hairpin resonators may be determined.

A frequency generator is capacitively coupled to a first hairpin resonator at the open-circuited end. The second or adjacent hairpin resonator located on the opposite surface of the substrate has the parallel members connected at the open-circuited end to provide an RF short. A detector circuit is used to detect the response of the first hairpin resonator with the second resonator RF shorted. The detected response reveals frequency $f_0$ which corresponds to a single-tuned circuit resonant frequency.

The connection at the open-circuited ends of the second adjacent hairpin resonator is now removed to create a double-tuned circuit. A detector circuit is again used to detect the response of the pair of hairpin resonators. The detected response reveals frequencies $f_1$ and $f_2$. The coupling coefficient (K) of the pair of hairpin resonators is represented by the following relationship:

$$K=(f_2-f_1)/f_0 \qquad [1]$$

where $f_2$ is the double-tuned circuit higher resonant frequency, $f_1$ is the double-tuned circuit lower resonant frequency, and $f_0$ is the single-tuned circuit resonant frequency.

Figure 6:
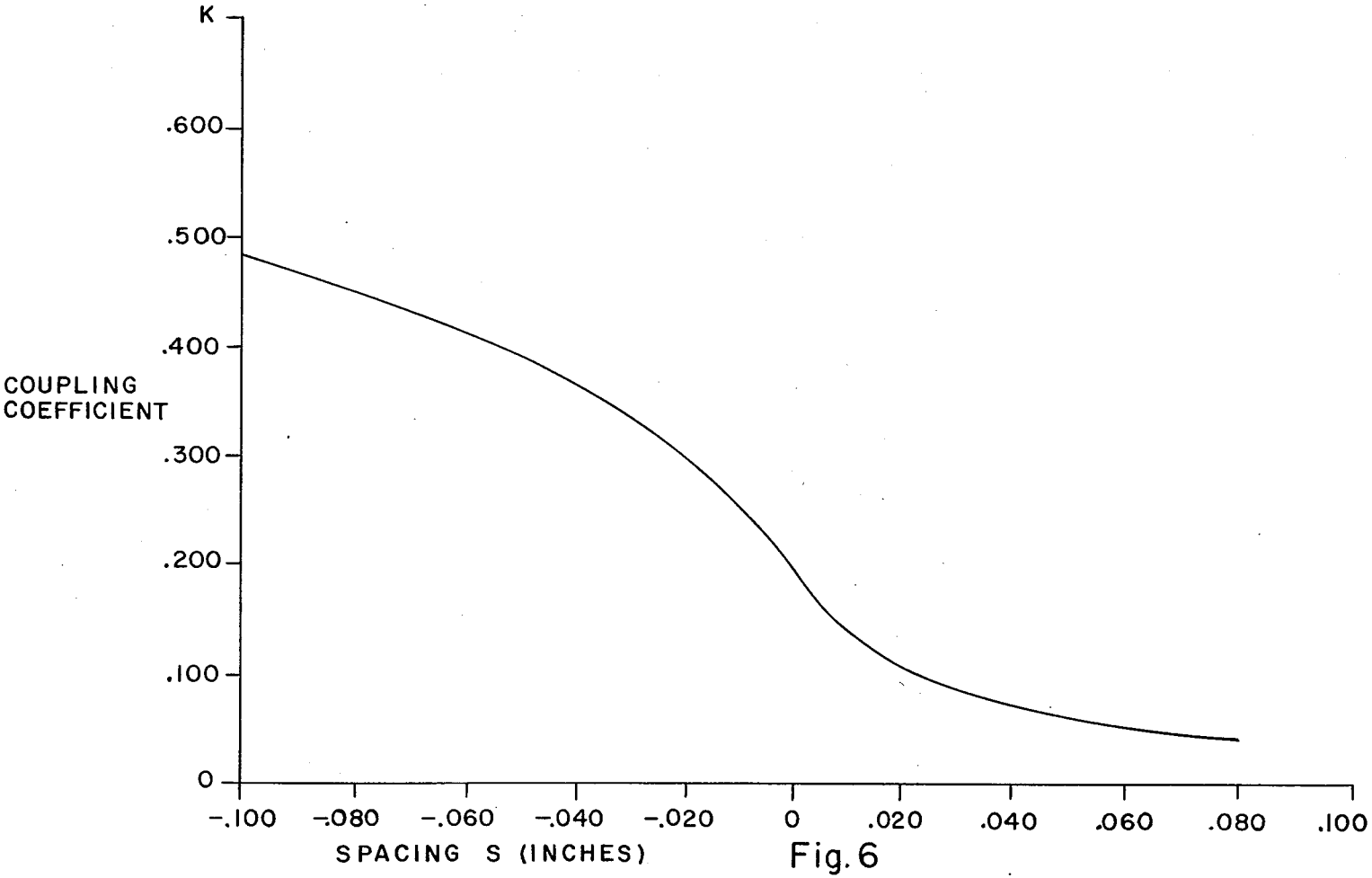
FIG. 6 is a graph illustrating the experimentially determined relationship between hairpin resonator spacing versus coupling for hairpin resonators having a fixed hairpin resonator stripwidth, W, and a fixed distance between stripline groundplanes, B.

This process is repeated for various resonator-pair spacings. A curve is thus generated wherein the coupling coefficient is plotted as a function of the spacing between adjacent resonators located on opposite surfaces of the substrate for a fixed H and W/B ratio. A representative curve is illustrated in FIG. 6. The negative spacing in the spacing axis indicates spatial overlap of adjacent hairpin resonators located on opposite surfaces of the substrate. The curve of FIG. 6 is then used in the design of a hairpin filter having substrates with identical thicknesses and dielectric constant along with identical dimensions of W and B as of the test structure.

Using the experimentally determined coupling coefficients a five pole Chebyshev filter may be designed and constructed. In this case the chosen filter ripple characteristic is equal to 0.001 dB and the passband is equal to $0.167f_0$ ($f_0$ being the resonant frequency of the filter). The substrate material used for the filter is a double side one ounce copper clad fiberglass material which has a dielectric constant, $E_R$, of 2.45. The hairpin resonator stripwidth is $W_1$, and the thickness between groundplanes, $B_1$, is 0.130 inches. The normalized coupling coefficient (k) and the normalized q for the five pole Chebyshev filter are obtained from the publication *Reference Data For Radio Engineers,* Sixth Edition, International Telephone and Telegraph Corp., Howard W. Sams Co. Inc., wherein:

$$q_2=q_3=q_4=\infty$$

$$q_1=q_5=0.822$$

$$k_{12}=k_{45}=0.845$$

$$k_{23}=k_{34}=0.545$$

The symbol $q_1$ designates the normalized q for the first hairpin resonator, $q_2$ designates the normalized q for the second hairpin resonator, and so on for $q_3$ through $q_5$. The symbol $k_{12}$ designates the normalized coupling coefficient between the first and second hairpin resonators, $k_{23}$ designates normalized the coupling coefficient between the second and third hairpin resonators, and so forth.

The normalized coupling coefficients (k) to the actual coupling coefficients (K) is related by the following expression:

$$K = k\left(\frac{BW_{3dB}}{f_0}\right) \quad [2]$$

where $BW_{3\,dB}$ is the filter 3 dB bandwidth and $f_0$ is the filter center frequency. The 3 dB bandwidth for the five pole Chebyshev filter is found from the referenced publication *Reference Data For Radio Engineers* as follows:

$$BW_{3dB} = \frac{\text{Passband}}{A} = \frac{0.167\,f_0}{0.79} = 0.21\,f_0 \quad [3]$$

where A=Bandwidth Ratio between ripple level and 3 dB points.

Therefore by determining the filter 3 dB bandwidth the coupling coefficients (K) may be calculated. The coupling coefficient for the first and second hairpin resonators, respectively hairpin resonators 14 and 15 of FIG. 1, are as follows:

$$K_{12} = k_{12}\left(\frac{BW_{3dB}}{f_0}\right) = 0.845\left(\frac{0.21\,f_0}{f_0}\right) = 0.179 \quad [4]$$

Similarly, the coupling coefficients may be calculated for the remaining hairpin resonators. Therefore, for hairpin resonators 15 and 16 the coupling coefficient $K_{23}=0.116$ and for hairpin resonator 16 and 17 the coupling coefficient $K_{34}=0.116$. The coupling coefficient of hairpin resonators 17 and 18 is $K_{45}=0.179$.

Summarizing the above, $$K_{12}=K_{45}=0.179 \text{ and}$$

$$K_{23}=K_{34}=0.116.$$

Having determined the coupling coefficients of the hairpin resonators, the spacing (S) between the hairpin resonators can be found from the curve illustrated in FIG. 6. In FIG. 4 the spacing between hairpin resonators 14 and 15 is designated as spacing, $S_{12}$. The spacing between hairpin resonators 15 and 16 is designated as spacing, $S_{23}$. The spacing between hairpin resonators 16 and 17 is designated as spacing, $S_{34}$; while the spacing between hairpin resonators 17 and 18 is designated as spacing, $S_{45}$.

Since coupling coefficients $K_{12}=K_{45}$, then from FIG. 6 spacings $S_{12}=S_{45}$ wherein spacing $S_{12}$ and $S_{45}$ are determined to be 0.002 inches. Accordingly, since coupling coefficients $K_{23}=K_{34}$, then from FIG. 6 spacings $S_{23}=S_{34}$ wherein spacing $S_{23}$ and $S_{34}$ are determined to be 0.017 inches.

Summarizing the above, $$S_{12}=S_{45}=0.002 \text{ inches}$$

$$S_{23}=S_{34}=0.017 \text{ inches}$$

The hairpin resonator spacings discussed above are not difficult to realize since all the hairpin resonators are etched alternately on opposite surfaces of substrate 12. In the present embodiment of the invention it is preferred that substrate 12 have a thickness ($H_1$) of 0.010 inches.

Figure 7A:
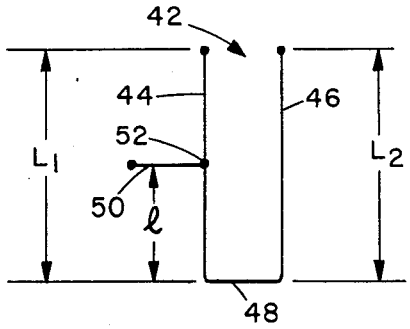

FIG. 7A is a schematical representation of a typical single tapped hairpin resonator 42. Hairpin resonator 42 comprises spaced parallel members 44 and 46 intersected at one end by perpendicular member 48. Hairpin resonator 42 also comprises tapping member 50 which perpendicularly intersects a parallel member, and as illustrated intersects parallel member 44. Hairpin resonator 42 is one-half wavelength ($\lambda/2$) long, measured from the end of parallel member 46 opposite perpendicular member 48 along parallel member 46 towards perpendicular member 48 (dimension $L_1$) plus from perpendicular member 48 along parallel member 44 to the end opposite perpendicular member 48 (dimension $L_2$). The distance $L_1=L_2$ and $L_1+L_2=\lambda/2$. Thus, the distance $L_1$ and $L_2$ are each one-quarter wavelength ($\lambda/4$). The length l is used for calculating the position of tapping member 50 along parallel member 44. The length l is a portion of the length $L_1$, measured from the intersection of perpendicular member 48 with parallel member 44 along the length of parallel member 44 to the intersection of tapping member 50 with parallel member 44 at tap point 52.

Figure 7B:
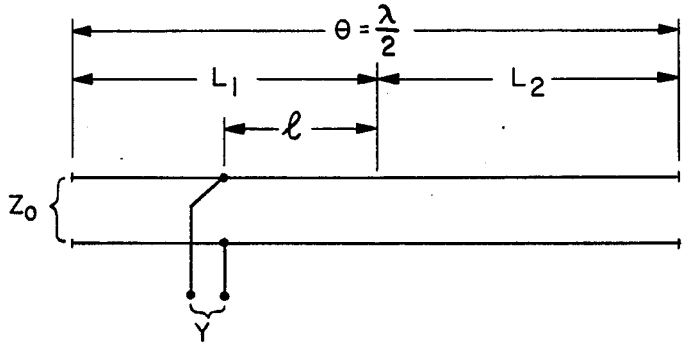
FIG. 7B illustrates the equivalent circuit of a tapped hairpin resonator.

Assuming minimum and negligible coupling between the parallel members 44 and 46, the equivalent circuit of tapped hairpin resonator 42 is illustrated in FIG. 7B. At near resonance the input admittance (Y) at the tap point 52 is defined by the following expression.

$$Y = \frac{\pi Y_0}{2\sin^2\theta_1}\left[\frac{1}{Q_S} + j2\frac{(f-f_0)}{f_0}\right] \quad [5]$$

where $Y_0$ is the characteristic admittance, $Q_S$ is the singly loaded Q, and f is the band edge frequency, provided that $$\left|\frac{f-f_0}{f_0}\right| << 1.0 \quad [6]$$

and $$\left[\frac{\theta(f-f_0)}{f_0}\right] \cot \theta_1 << 1.0 \quad [7]$$

where $\theta$ is the half wave electrical length.

Therefore, the expression defining the singly loaded Q, ($Q_s$), is as follows:

$$\frac{Q_s}{(R/Z_0)} = \frac{\pi}{2 \sin^2\theta_1} \quad [8]$$

where $$\theta_1 = \frac{\pi l}{2L} \quad [9]$$

and R is the generator impedance and $Z_0$ is the filter internal impedance.

Using equation [8] and the following equation [10]:

$$Q_s = q\left(\frac{f_0}{BW_{3dB}}\right) \quad [10]$$

where $Q_s$ is the singly loaded Q tapped into the hairpin resonator, and q is the normalized loaded Q. For the exemplified five pole Chebyshev filter where $Q_1=Q_5$, the corresponding singly loaded Q ($Q_1$ and $Q_5$) may be determined as follows:

$$Q_1 = Q_5 = q_1\left(\frac{f_0}{BW_{3dB}}\right) \quad [11]$$

$$= 0.822\left(\frac{f_0}{0.21 f_0}\right)$$

$$= 3.875$$

The tap point location is then calculated using equation [8] where R and $Z_0$ are 50 ohms and 1/L is found to be approximately 0.43. Since $L_1=L_2=\lambda/4$ at $f_0$ with the dielectric constant $E_R=2.45$, L may be calculated from the following expression:

$$L_1 = \frac{\lambda}{4\sqrt{E_R}} \quad [12]$$

$$= \frac{C}{4f_0\sqrt{E_R}}$$

where C equals the speed of light ($3\times10^8$ meters/-second) and $f_0$ is the resonant frequency. The distance l, being the distance from the short-circuited ends of the hairpin resonators to the tapping member, may then be calculated from equation [9].

Figure 8:
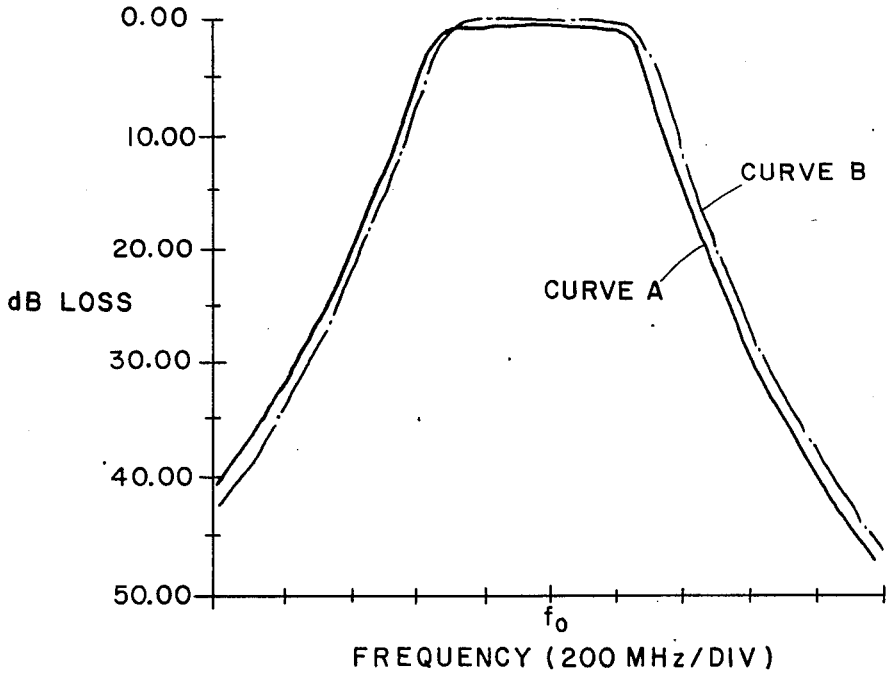
FIG. 8 is a graph wherein Curve A illustrates the filter response of a five pole square corner tapped-line hairpin filter while Curve B illustrates the filter response of a five pole round corner tapped-line hairpin filter.

Referring to FIG. 8, Curves A and B respectively illustrate the filter response of a five pole Chebyshev square corner hairpin filter and a round corner hairpin filter of the present invention. Although both filters are designed at a center frequency $f_0$ the round corner hairpin filter embodiment is centered slightly higher than the square corner hairpin filter embodiment. This effect is a result of the round corners physically shortening the resonator length. Therefore, the round corner hairpin resonators electrically appear shorter with a resulting higher frequency.

The exemplary embodiment described herein illustrates a five pole filter, however, it is possible that an even number pole filter may be used. With an even number pole filter, the input and output tapped hairpin resonators would be located on opposite surfaces of a substrate. An over-and-under stripline connection would be required to couple one of the tapped members to a stripline input/output connection.

The previous description of the preferred embodiments are provided to enable any person skilled in the art to make or use the present invention. Various modifications to these embodiments will be readily apparent to those skilled in the art, and the generic principles defined herein may be applied to other embodiments without the use of the inventive faculty. Thus, the present invention is not intended to be limited to the embodiment shown herein, but is to be accorded the widest scope consistent with the principles and novel features disclosed herein.

I claim:

1. A stripline tapped-line hairpin filter comprising:

a first dielectric substrate;

a plurality of hairpin resonators disposed alternately on opposite surfaces of said first substrate, certain ones of said hairpin resonators located on one surface of said first substrate and certain other ones of said hairpin resonators located on the other surface of said first substrate with said first substrate separating said certain ones of said hairpin resonators from said certain other ones of said hairpin resonators and said certain ones and said certain other ones of said hairpin resonators having noncongruent adjacent edges, each hairpin resonator positioned in a spaced parallel relationship with respect to an adjacent hairpin resonator located on an opposite surface of said first substrate such that each hairpin resonator is in a parallel coupled relationship with an adjacent hairpin resonator disposed on an opposite surface of said first substrate, and the first and last hairpin resonator on said first substrate each includes an interconnected tapping member disposed upon a surface of said first substrate to which the corresponding first and last hairpin resonator is disposed and respectively extends toward opposite ends of said first substrate for respectively coupling a signal into and out of said hairpin resonators;

second and third dielectric substrates each having a pair of surfaces, one surface of said second substrate located adjacent to said certain ones of said hairpin resonators and one surface of said third substrate located adjacent to said certain other ones of said hairpin resonators; and first and second groundplanes each having a pair of surfaces, one surface of said first groundplane mounted upon said second substrate other surface and one surface of said second groundplane mounted upon said third substrate other surface.

2. The stripline tapped-line filter of claim 1, wherein said certain ones of said hairpin resonators located on said one surface have a generally U-shape orientation and said certain other ones of said hairpin resonators located on said other surface of said first substrate have a reverse orientation with respect to the U-shape orientation of said certain ones of said hairpin resonators.

3. The stripline tapped-line filter of claim 1 further comprising first and second conductive plates respectively located adjacent said first and second groundplanes.

4. The stripline tapped-line filter of claim 2 wherein the dielectric constant of said first, second, and third substrates are equal.

5. The stripline tapped-line filter of claim 4 wherein said first, second, and third substrates are comprised of a fiberglass material having a dielectric constant of 2.45.

6. A stripline tapped-line filter comprising:

a first dielectric substrate;

a plurality of N U-shaped hairpin resonators, each being a half-wavelength open-circuited hairpin resonator, disposed alternately on first and second parallel planar surfaces of said first substrate, certain ones of said hairpin resonators located on said first surface and certain other ones of said hairpin resonators located on said second surface with said first substrate separating said certain ones of said hairpin resonators from said certain other ones of said hairpin resonators and said certain ones and said certain other ones of said hairpin resonators having noncongruent adjacent edges, each hairpin resonator positioned in a spaced parallel relationship with respect to an adjacent hairpin resonator located on an opposite one of said first and second surfaces such that each hairpin resonator is in a parallel coupled relationship with an adjacent hairpin resonator disposed on an opposite one of said first and second surfaces, each hairpin resonator including first and second spaced parallel members interconnected at one end and by a third member perpendicular to said first and second members, and the first and last hairpin resonators disposed on said first substrate each including an interconnected fourth member disposed on a respective one of said first and second surfaces to which a corresponding first and last hairpin resonator is disposed for respectively coupling a signal into and out of said hairpin resonators, said first hairpin resonator fourth member perpendicularly intersecting with said first hairpin resonator first member and extending outwardly along a corresponding one of said first and second surfaces towards one end of said first substrate and said last hairpin resonator fourth member perpendicularly intersecting with said last hairpin resonator second member and extending outwardly along a corresponding one of said first and second surfaces towards the other end of said first substrate;

a second dielectric substrate having third and fourth surfaces substantially parallel to and coextensive with said first and second surfaces, said third surface located adjacent to said certain ones of said hairpin resonators;

a third dielectric substrate having fifth and sixth surfaces substantially parallel to and coextensive with said first and second surfaces, said fifth surface located adjacent to said certain other ones of said hairpin resonators;

a first groundplane having seventh and eighth surfaces substantially parallel to and coextensive with said third and fourth surfaces, said seventh surface mounted upon said fourth surface; and a second groundplane having ninth and tenth surfaces substantially parallel to and coextensive with said fifth and sixth surfaces, said ninth surface mounted upon said sixth surface.

7. The stripline tapped-line filter of claim 6 wherein said certain other ones of said hairpin resonators located on said second surface have a reverse U-shape orientation with respect to the U-shape orientation of said certain ones of said hairpin resonators on said first surface of said first substrate.

8. The stripline tapped-line filter of claim 7 further comprising first and second conductive plates respectively located adjacent said first and second groundplanes eighth and tenth surfaces.

9. The stripline tapped-line filter of claim 8 wherein said plurality of N hairpin resonators consists of five hairpin resonators.

10. The stripline tapped-line filter of claim 7 wherein said plurality of N hairpin resonators are comprised of an electrically conductive material.

11. The stripline tapped-line filter of claim 10 wherein said plurality of N hairpin resonators are comprised of copper.

12. The stripline tapped-line filter of claim 8 wherein said first and second conductive plates are comprised of aluminum.

* * * * *